US011512933B2

(12) United States Patent
Kirsch et al.

(10) Patent No.: US 11,512,933 B2
(45) Date of Patent: Nov. 29, 2022

(54) ARROW OR BOLT HAVING AT LEAST ONE LIGHT EMITTING ELEMENT POSITIONED OFF THE CENTER AXIS OF THE SHAFT OF THE ARROW OR BOLT, AND DEVICES AND METHODS FOR PROVIDING SUCH AN ARROW OR BOLT

(71) Applicant: Kirsch, LLC, New Munster, WI (US)

(72) Inventors: Phillip Kirsch, Burlington, WI (US); Tim Crabtree, Yorba Linda, CA (US)

(73) Assignee: Kirsch, LLC, New Munster, WI (US)

( * ) Notice: Subject to any disclaimer, the term of this patent is extended or adjusted under 35 U.S.C. 154(b) by 0 days.

(21) Appl. No.: 17/181,358

(22) Filed: Feb. 22, 2021

(65) Prior Publication Data

US 2021/0262773 A1 Aug. 26, 2021

Related U.S. Application Data

(60) Provisional application No. 62/979,062, filed on Feb. 20, 2020.

(51) Int. Cl.

| | |
|---|---|
| ***F42B 6/04*** | (2006.01) |
| ***F21V 33/00*** | (2006.01) |
| ***F42B 6/06*** | (2006.01) |
| *F21Y 115/10* | (2016.01) |

(52) U.S. Cl.

CPC ..... *F42B 6/04* (2013.01); *F21V 33/008* (2013.01); *F42B 6/06* (2013.01); *F21Y 2115/10* (2016.08)

(58) Field of Classification Search

CPC ..... F42B 6/04; F42B 6/06

See application file for complete search history.

(56) References Cited

U.S. PATENT DOCUMENTS

| | | | | |
|---|---|---|---|---|
| 7,862,457 | B1 * | 1/2011 | Urcheck | F42B 12/382 473/578 |
| 8,123,636 | B1 * | 2/2012 | Temprine | F42B 6/06 473/578 |
| 8,152,663 | B2 * | 4/2012 | Grundman | F42B 6/04 473/578 |
| 9,151,580 | B2 * | 10/2015 | Pedersen | F42B 6/02 |
| 2011/0218063 | A1 * | 9/2011 | Hunt | A63B 65/02 473/578 |

* cited by examiner

*Primary Examiner* — John A Ricci
(74) *Attorney, Agent, or Firm* — K&L Gates LLP

(57) ABSTRACT

One aspect is an illumination assembly including: a first light emitting element; a first counterweight; and at least one of a nock or a connector configured to attach the illumination assembly to a nock, such that the first light emitting element and the first counterweight are positioned symmetrically from each other relative to the nock on opposite sides of the nock. Preferably the first light emitting element is substantially the same mass as the first counterweight. The illumination assembly can include a shaft of an arrow or bolt and/or include an adapter configured to attach to a shaft of an arrow or bolt, such that the first light emitting element and the first counterweight are collinear on a virtual line substantially perpendicular to the central axis of the arrow or bolt, and such that the first light emitting element is positioned off of the central axis of the arrow or bolt and configured to emit light in a rearward direction offset from the central axis of the arrow or bolt.

27 Claims, 10 Drawing Sheets
(3 of 10 Drawing Sheet(s) Filed in Color)

ARROW OR BOLT HAVING AT LEAST ONE LIGHT EMITTING ELEMENT POSITIONED OFF THE CENTER AXIS OF THE SHAFT OF THE ARROW OR BOLT, AND DEVICES AND METHODS FOR PROVIDING SUCH AN ARROW OR BOLT

PRIORITY CLAIM

This application claims priority to U.S. Provisional Patent Application Ser. No. 62/979,062 filed Feb. 20, 2020, the entire contents of which are incorporated herein by reference.

TECHNICAL FIELD

The disclosures herein relate generally to an apparatus for archery. More specifically, a light emitting element is positioned off the center axis of an arrow or bolt to emit light that identifies to a user at least one of the path of the arrow or bolt or a location of the arrow or bolt.

BACKGROUND

Arrow-mounted light emitting devices are known in the hunting and archery industry. For example, an archer can launch an arrow along with the attached light emitting device into a target such as an animal. The light emitting device can allow the archer to determine if the target was hit by the arrow and, if so, follow any subsequent movements by the target. The light emitting device can also assist the archer to retrieve the arrow. Some arrow-mounted light emitting devices are positioned on the nock of the arrow opposite from the broadhead or tip to thereby emit the light rearward relative to the path of the arrow so that the animal is less likely to see the light before being hit by the arrow and so that the light is more easily viewed by the archer.

SUMMARY

The present inventor recognized that the shape of the nock of an arrow or bolt is dictated by the function of the nock to grip the bowstring, and this shape is incompatible with the desire to focus the emitted light rearward relative to the path of the arrow. Furthermore, to the best knowledge of the present inventor, all known light emitting devices are located in front of the nock or embedded in the nock to allow the nock to make substantial contact to the bow or crossbow string. The result of this known design is the emitters push light either through plastic or down a tunnel through a hole in the plastic, both losing an amount of light viewable by the user. Some of these devices position the emitter on the central axis to minimize the size of the light emitting device and to preserve the balance of the nock and its arrow.

However, the present inventor implemented the concept that balance can also be maintained by the use of symmetry in the design, even if the components are mounted off axis. The present inventor discovered that a light emitting element associated with and/or incorporated into a nock of an arrow or bolt and positioned off the center axis of the arrow or bolt advantageously provides light emission that is not dispersed by the shape of the nock. Such a light emitting device was experimentally tested (as discussed later herein) and shown to be superior to known arrow-mounted light emitting devices because it provides more rearward focused light than known arrow-mounted light emitting devices, in a way that is compatible with proper functioning of the arrow (e.g., does not interfere with cooperative interaction between the nock and a bowstring).

BRIEF DESCRIPTION OF THE FIGURES

The patent or application file contains at least one drawing executed in color. Copies of this patent or patent application publication with color drawing(s) will be provided by the Office upon request and payment of the necessary fee.

DETAILED DESCRIPTION

Definitions

Figure 1:
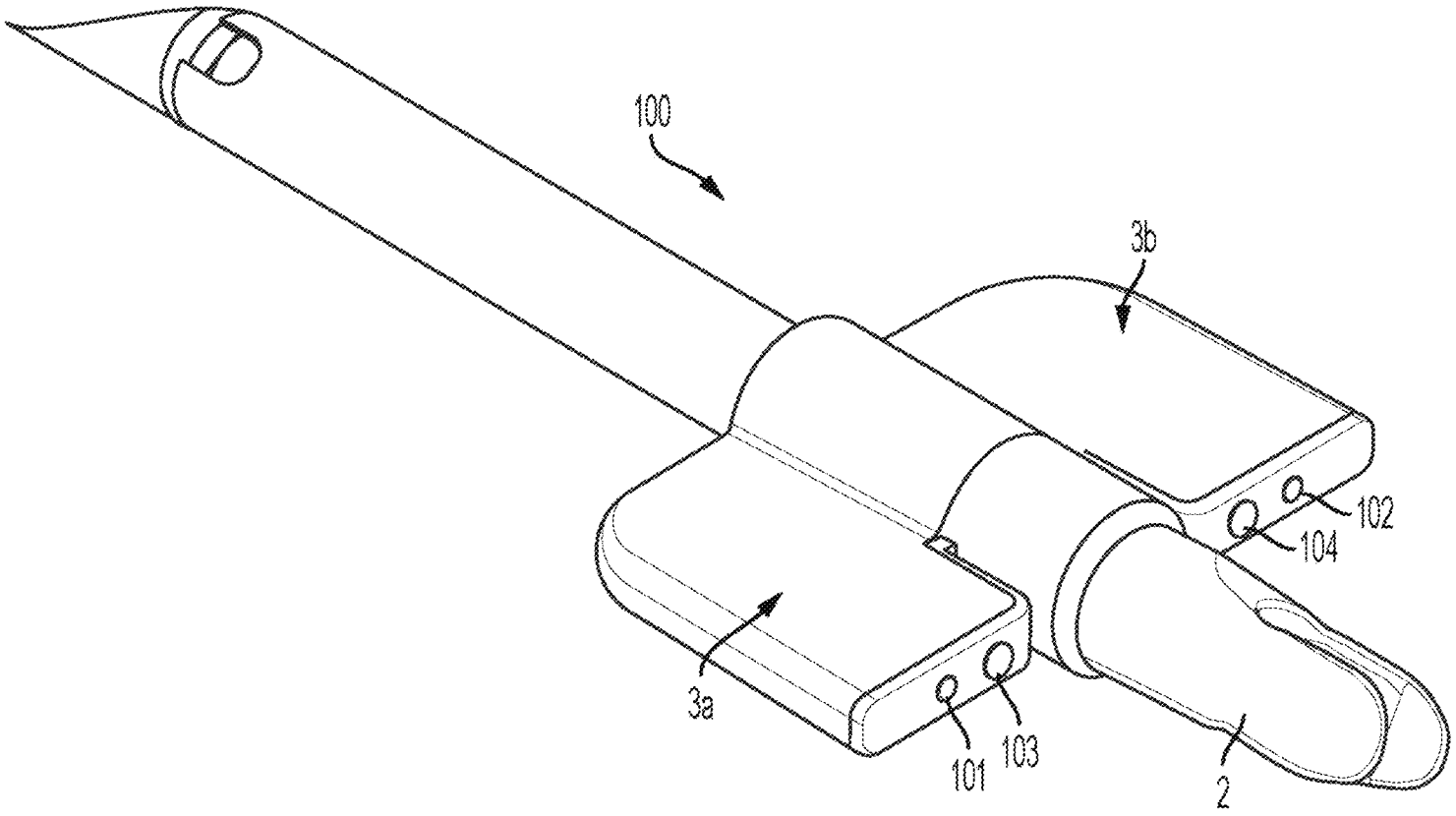
FIG. 1 is a side perspective view of an embodiment of n illumination assembly according to the present disclosure.

Some definitions are provided hereafter. Nevertheless, definitions may be located in the "Embodiments" section below, and the above header "Definitions" does not mean that such disclosures in the "Embodiments" section are not definitions.

As used herein, "about," "approximately," "essentially" and "substantially" are understood to refer to numbers in a range of numerals, for example the range of −10% to +10% of the referenced number, preferably −5% to +5% of the referenced number, more preferably −1% to +1% of the referenced number, even more preferably −0.1% to +0.1% of the referenced number, most preferably −0.01% to +0.01% of the referenced number.

As used herein and in the appended claims, the singular form of a word includes the plural, unless the context clearly dictates otherwise. Thus, the references "a," "an" and "the" are generally inclusive of the plurals of the respective terms. For example, reference to "a light emitting element" or "the light emitting element" includes a plurality of such "light emitting elements." The term "and/or" used in the context of "X and/or Y" should be interpreted as "X," or "Y," or "X and Y." Similarly, "at least one of X or Y" should be interpreted as "X," or "Y," or "both X and Y."

The words "comprise," "comprises," and "comprising" are to be interpreted inclusively rather than exclusively. Likewise, the terms "include," "including" and "or" should all be construed to be inclusive, unless such a construction is clearly prohibited from the context. However, the embodiments provided by the present disclosure may lack any element that is not specifically disclosed herein. Thus, a disclosure of an embodiment defined using the term "comprising" is also a disclosure of embodiments "consisting essentially of" and "consisting of" the disclosed components.

Where used herein, the term "example," particularly when followed by a listing of terms, is merely exemplary and illustrative, and should not be deemed to be exclusive or comprehensive. Any embodiment disclosed herein can be combined with any other embodiment disclosed herein unless explicitly indicated otherwise.

Embodiments

The present disclosure provides an illumination assembly for archery, such as hunting game. The illumination assembly can be configured to position at least one light emitting element off the central axis of an arrow or bolt. For example, the illumination assembly can position at least one light emitting element symmetrically from a counterweight on an opposite side of a nock of an arrow or bolt.

In one embodiment, the tracking apparatus is part of a nock assembly comprising a notch configured to interact with a bow string. In other embodiments, the detachable tracking apparatus can be one or more components separate from a nock assembly and configured to attach to the nock assembly to allow the archer to use their preferred nock. The light emitting element can illuminate an arrow or bolt to thereby allow the archer to view the path of the arrow or bolt as it is launched from a bow or crossbow respectively and/or allow the archer to retrieve the arrow or bolt after it has been launched.

For example, the light emitting element can be part of a continuous unit integrated with the nocking function, such that the unit comprising the light emitting element is configured to reversibly receive the string of a bow. As another example, the light emitting element can be part of an independent unit that attaches to the nock, preferably by pin nock design, nock insert design, nock outsert design, or the like. In this example, the nock can be chosen by the archer and may be any design that is compatible with a mounting mechanism provided by the independent unit comprising the light emitting element. Preferably the nock is made of one or more opaque materials because substantially all of the light emitted by the light emitting element is not transmitted through the nock. Regardless of the embodiment, the light emitting element is preferably positioned between the rearward end of the arrow shaft and the rearward end of the nock.

Figure 2:
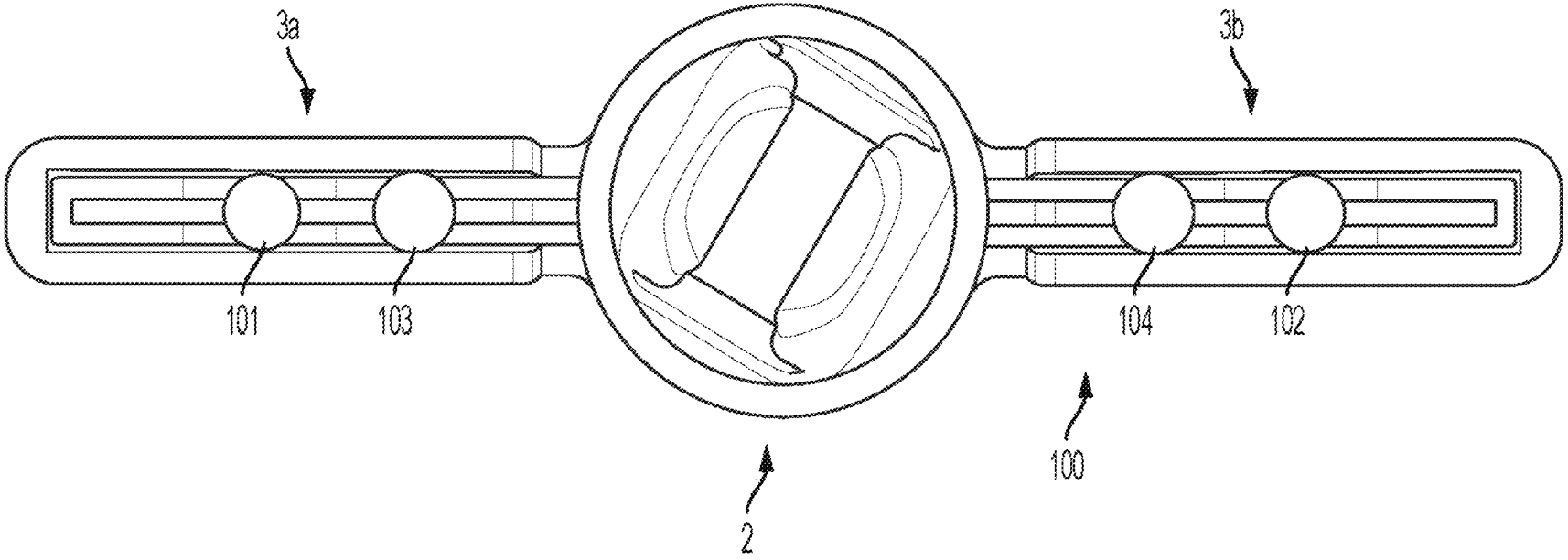
FIG. 2 is a rear plan view of an embodiment of an illumination assembly according to the present disclosure.
Figure 3:
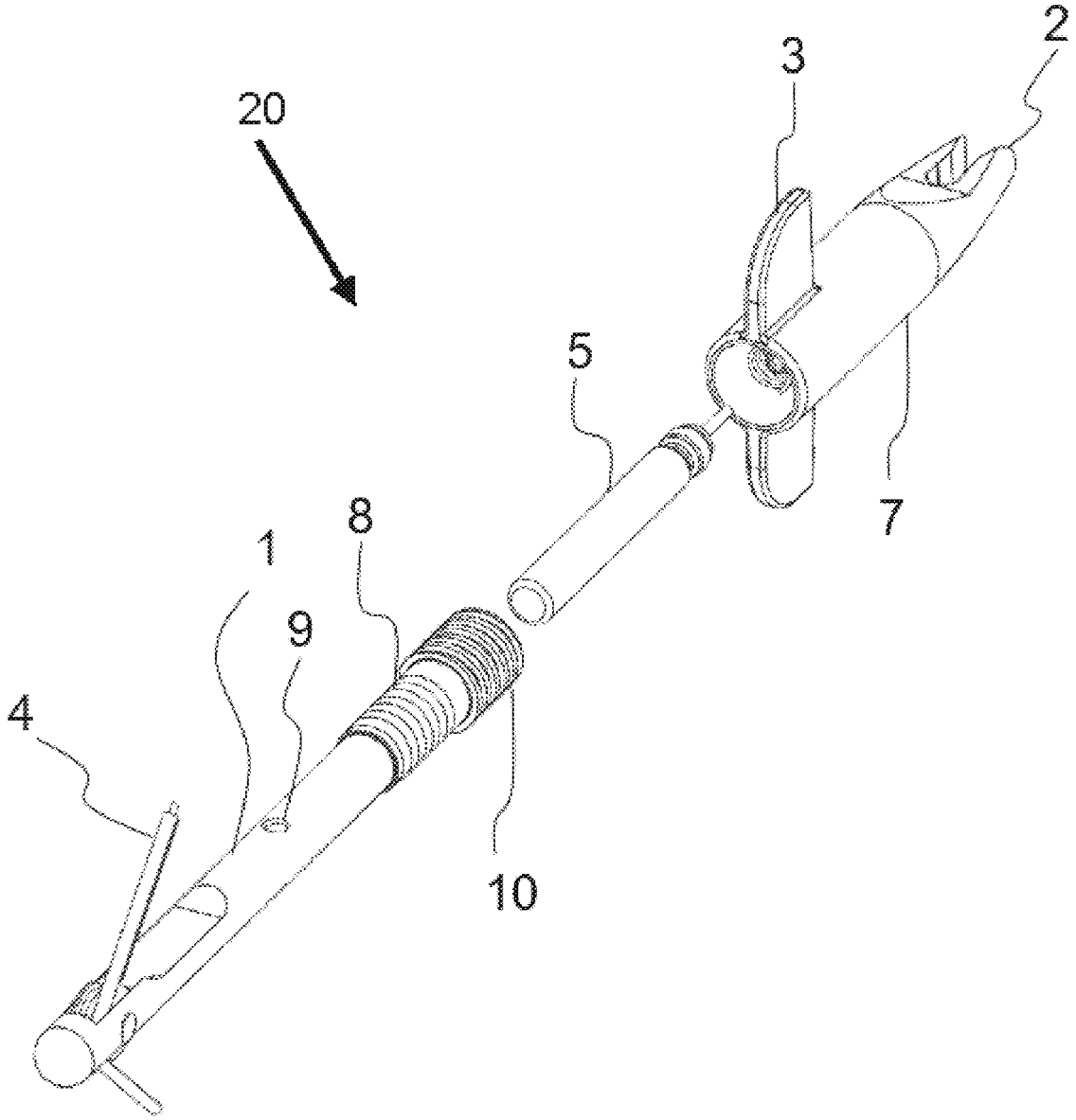
FIG. 3 is an exploded perspective view of an embodiment of a detachable tracking apparatus.
Figure 4:
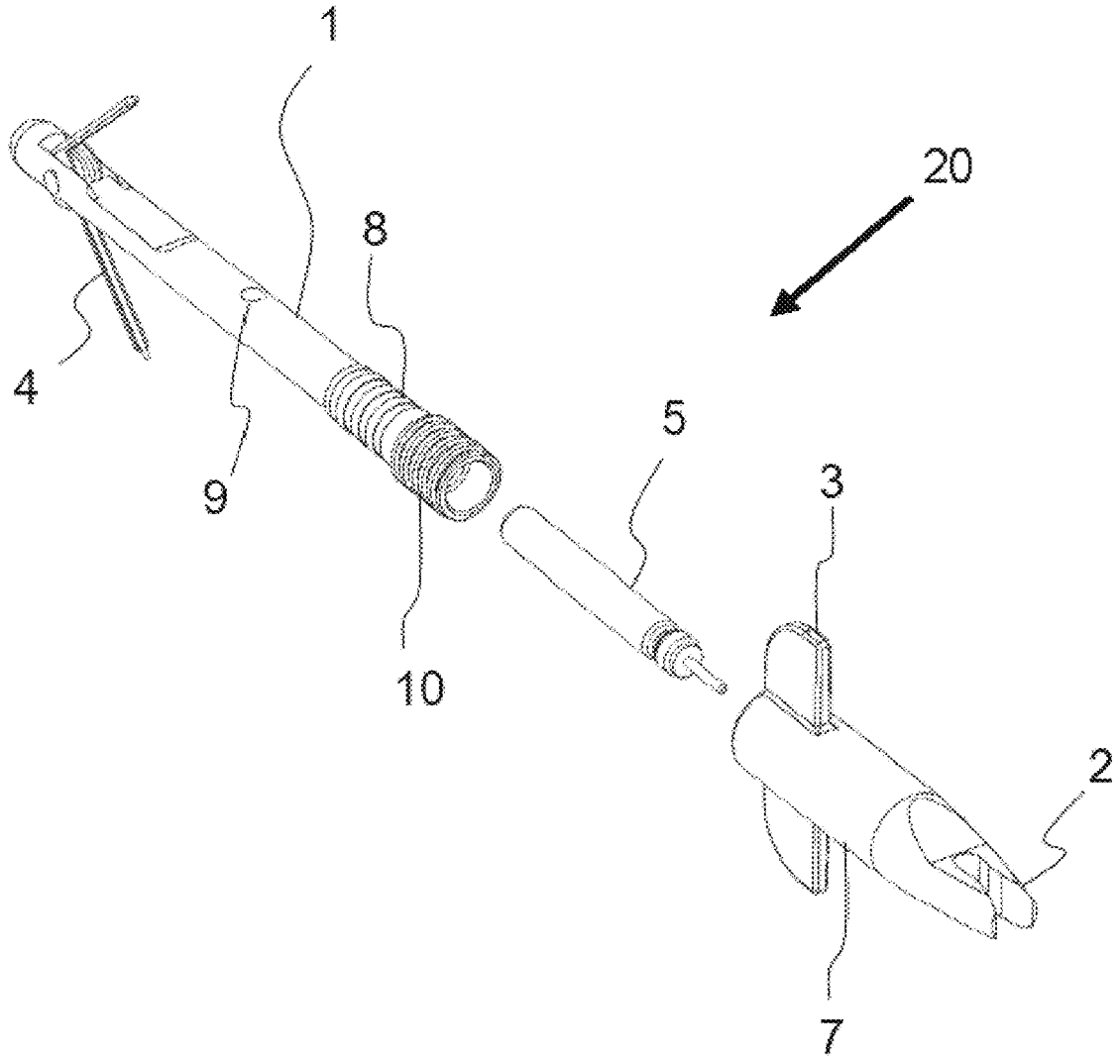
FIG. 4 is an exploded perspective view of an embodiment of a detachable tracking apparatus.
Figure 5:
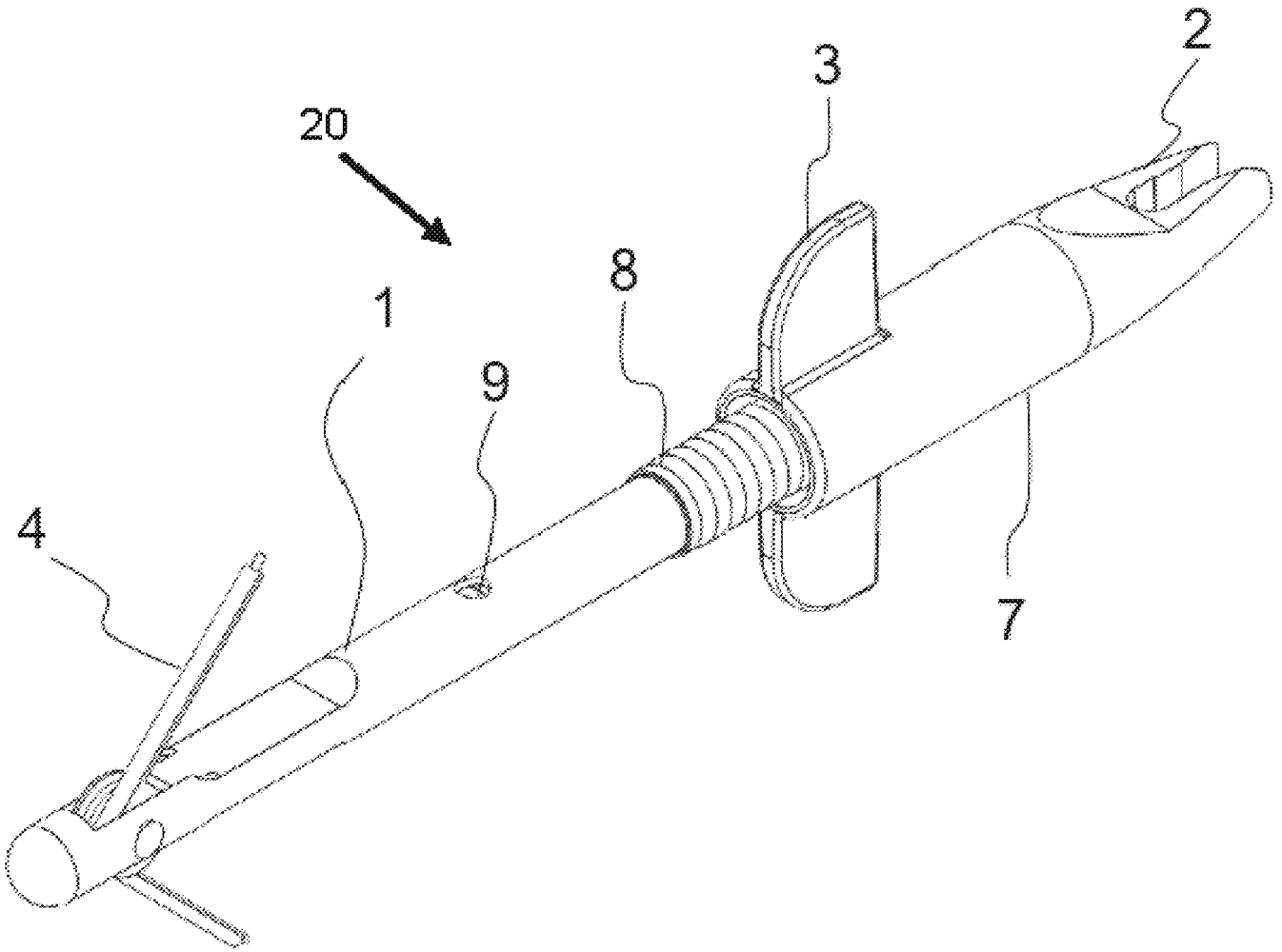
FIG. 5 is a perspective view of an embodiment of a detachable tracking apparatus ready for insertion into an arrow shaft.
Figure 6:
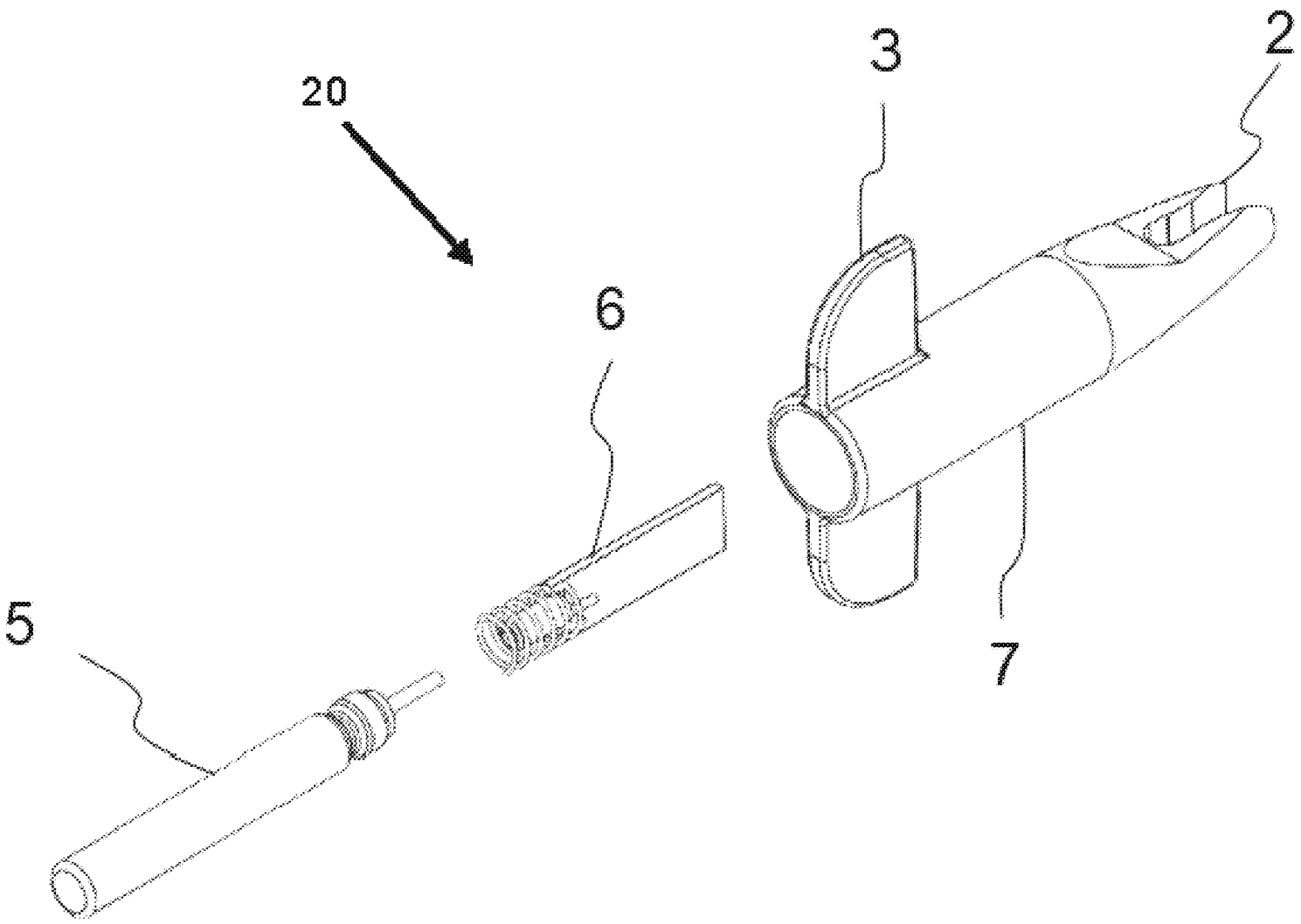
FIG. 6 is an exploded view of an embodiment of a detachable tracking apparatus containing a stopping component, a battery, a PCB, and an arrow nock.

FIGS. 1 and 2 generally depict a non-limiting embodiment of an illumination assembly 100 according to the present disclosure. The illumination assembly 100 is used with a nock 2 that is part of an arrow or bolt. Additionally or alternatively, the nock 2 can be part of a nock assembly comprising a connector configured to connect to an arrow or bolt, for example the rearward end of an arrow or bolt. A central axis of the arrow or bolt extends through a tip of the arrow or bolt and the nock 2 of the arrow or bolt, and the shaft of the arrow or bolt extends along the central axis.

The nock 2 is positioned on the central axis of the arrow or bolt. The illumination assembly 100 comprises at least one light emitting element. Each of the at least one light emitting element can be a light-emitting diode or any suitable light source that emits light, preferably when current runs through the light emitting element.

For example, the illumination assembly 100 can comprise a first light emitting element 101. The illumination assembly 100 further comprises a first counterweight 102 on an opposite side of the nock 2 from the first light emitting element 101, preferably approximately one hundred eighty degrees from each other. The first counterweight 102 and the first light emitting element 101 are preferably collinear on a virtual line that is substantially perpendicular to the central axis of the arrow or bolt.

The first counterweight 102 is preferably a second light emitting element, although optionally the first counterweight 102 does not emit any light. The first light emitting element 101 and the first counterweight 102 can be substantially the same mass as each other.

The first light emitting element 101 and the first counterweight 102 are preferably positioned symmetrically relative to the nock 2. For example, the first light emitting element 101 and the first counterweight 102 are substantially the same distance from the central axis of the arrow or bolt as each other, along a virtual line that is substantially perpendicular to the central axis of the arrow or bolt; in some embodiments substantially the same distance from the nock 2 as each other, along a virtual line that is substantially perpendicular to the central axis of the arrow or bolt. As noted above, the nock 2 can be part of the illumination assembly 100 or otherwise integral with the illumination assembly 100, or additionally or alternatively the illumination assembly 100 can be one or more components separate from the nock 2 and comprising a connector configured for the archer to connect the illumination assembly 100 to the nock 2.

The present disclosure is not limited to a specific number of light emitting elements, and the illumination assembly 100 can comprise any number of light emitting elements as long as each light emitting element is counterbalanced by either another light emitting element or a counterweight without light emitting capability.

For example, the illumination assembly 100 can comprise exactly one light emitting element, such as an embodiment in which the illumination assembly 100 comprises the first light emitting element 101, which is the only light emitting element, counterbalanced by the first counterweight 102, which is without light emitting capability.

Another example of the illumination assembly 100 comprises exactly two light emitting elements, such as an embodiment in which the illumination assembly 100 comprises the first light emitting element 101 counterbalanced by a second light emitting element; or an embodiment in which the illumination assembly 100 comprises the first light emitting element 101 counterbalanced by the first counterweight 102, which is without light emitting capability, and further comprises a second light emitting element counterbalanced by a second counterweight, which is without light emitting capability, with the first and second light emitting elements and the first and second counterweights positioned at approximately ninety degree angles relative to each other; or an embodiment in which the illumination assembly 100 comprises the first light emitting element 101, a second light emitting element, and a first counterweight 102 that counterbalance each other (e.g., the first and second light emitting elements and the first counterweight are positioned at approximately one hundred-twenty degree angles relative to each other).

Another example of the illumination assembly 100 comprises exactly two light emitting elements, such as an embodiment in which the illumination assembly 100 comprises the first light emitting element 101 counterbalanced by a second light emitting element; or an embodiment in which the illumination assembly 100 comprises the first light emitting element 101 counterbalanced by the first counterweight 102, which is without light emitting capability, and further comprises a second light emitting element counterbalanced by a second counterweight, which is without light emitting capability, with the first and second light emitting elements and the first and second counterweights positioned at approximately ninety degree angles relative to each other; or an embodiment in which the illumination assembly 100 comprises the first light emitting element 101, a second light emitting element, and a first counterweight 102 that counterbalance each other (e.g., the first and second light emitting elements and the first counterweight are positioned at approximately one hundred-twenty degree angles relative to each other).

The illumination assembly 100 can comprise a first wing 3*a* comprising the first light emitting element 101 and/or connected to the first light emitting element 101. The illumination assembly 100 can comprise a second wing 3*b* comprising the first counterweight 102 and/or connected to the first counterweight 102. The first wing 3*a* and the second wing 3*b* can be coplanar with each other for their top surfaces and/or coplanar with each other for their bottom surfaces. In some embodiments, the first and second wings 3*a*,3*b* are configured to separate the illumination assembly 100 from the shaft of the arrow or bolt when impacting an animal or other target.

Preferably the first light emitting element 101 is positioned on a rearward facing surface of the first wing 3*a*, not overlapping with the nock 2 when viewed from the back of the arrow or bolt; and the first counterweight 102 is positioned on a rearward facing surface of the second wing 3*b*, not overlapping with the nock 2 when viewed from the back of the arrow or bolt. The rearward facing surface of the first wing 3*a* can be coplanar with the rearward facing surface of the second wing 3*b*. The distance of the first light emitting element 101 along the length of the rearward facing surface of the first wing 3*a* is preferably approximately equal to the distance of the first counterweight 102 along the length of the rearward facing surface of the second wing 3*b*.

The first and second wings 3*a*,3*b* can be made of any durable material, such as a plastic polymer, carbon, aluminum, or a light-weight alloy. Preferably the first and second wings 3*a*,3*b* comprise a leading edge that is substantially perpendicular to the central axis of the arrow and/or substantially parallel to the corresponding rearward facing surface.

The present disclosure is not limited to a specific number of wings, and the illumination assembly 100 can comprise any number of wings as long as each light emitting element is counterbalanced by either another light emitting element or a counterweight without light emitting capability.

For example, the illumination assembly 100 can comprise exactly two wings, such as an embodiment in which the illumination assembly 100 comprises the first and the second wings 3*a*,3*b*.

Another example of the illumination assembly 100 comprises exactly three wings, such as an embodiment in which the illumination assembly 100 comprises the first wing 3*a*, the second wing 3*b* and a third wing, preferably positioned at approximately one hundred-twenty degree angles relative to each other. The first wing 3*a* can comprise the first light emitting element 101, the second wing 3*b* can comprise the first counterweight 102 that can be a second light emitting element or a counterweight without light emitting capability, and the third wing can comprise a second counterweight that can be an additional light emitting element or an additional counterweight without light emitting capability.

Another example of the illumination assembly 100 comprises exactly four wings, such as an embodiment in which the illumination assembly 100 comprises the first wing 3*a*, the second wing 3*b*, a third wing and a fourth wing, preferably positioned at approximately ninety degree angles relative to each other. The first wing 3*a* can comprise the first light emitting element 101, the second wing 3*b* can comprise the first counterweight 102 that can be a second light emitting element or a counterweight without light emitting capability, the third wing can comprise a second counterweight that can be an additional light emitting element or an additional counterweight without light emitting capability, and the fourth wing can comprise a third counterweight that can be an additional light emitting element or an additional counterweight without light emitting capability. In some embodiments, the illumination assembly 100 comprises at least one power charging element configured to charge a power source 5 in the illumination assembly 100. The power source 5 can provide current to the at least one light emitting element, such as the first light emitting element 101 and any additional light emitting elements, e.g., the embodiment of the first counterweight 102 that is a second light emitting element.

For example, the at least one power charging element can comprise a first power charging element 103 and a second power charging element 104 that are substantially the same mass as each other. The first power charging element 103 and the second power charging element 104 are preferably positioned symmetrically relative to the nock 2. For example, the first power charging element 103 and the second power charging element 104 can be substantially the same distance from the central axis of the arrow or bolt as each other, along a virtual line that is substantially perpendicular to the central axis of the arrow or bolt; in some embodiments substantially the same distance from the nock 2 as each other, along a virtual line that is substantially perpendicular to the central axis of the arrow or bolt.

The first wing 3*a* can comprise the first power charging element 103 and/or connect to the first power charging element 103. The second wing 3*b* can comprise the second power charging element 104 and/or connect to the second power charging element 104. Preferably the first power charging element 103 is positioned on the rearward facing surface of the first wing 3*a*, not overlapping with the nock 2 when viewed from the back of the arrow or bolt; and the second power charging element 104 is positioned on the rearward facing surface of the second wing 3*b*, not overlapping with the nock 2 when viewed from the back of the arrow or bolt.

The first and second power charging elements 103,104 can provide power to the power source 5. The power source 5 can be could be a rechargeable battery, a primary battery, a charged capacitor, a miniature fuel cell, or any other component suitable for providing power to the at least one light emitting element, such as the first light emitting element 101 and, if the first counterweight 102 is a second light emitting element, the second light emitting element. The illumination assembly 100 can further comprise means for activating and/or deactivating the at least one light emitting element.

Moreover, the illumination assembly 100 can optionally comprise means for attaching the illumination assembly 100 directly or indirectly (e.g., by an adapter) to a shaft of an arrow or bolt. For example, the illumination assembly 100 can be configured for one or more of: attachment to the arrow or bolt by a pin adapter (e.g., a pin adapter that is part of the illumination assembly 100 and/or part of the arrow or bolt); attachment to the arrow or bolt by an insertion method (e.g., the illumination assembly 100 can insert into the shaft of the arrow or bolt, or the shaft of the arrow or bolt can insert into the illumination assembly 100 and/or part of the arrow or bolt); attachment to the arrow or bolt by a connector initially separate from the arrow or bolt and/or initially separate from the illumination assembly 100).

Additionally or alternatively, the illumination assembly 100 can optionally comprise means for attaching the illumination assembly 100 directly or indirectly (e.g., by an adapter) to the nock 2, such as a commercially available nock. For example, the illumination assembly 100 can be configured for one or more of: attachment to the nock 2 by a pin adapter (e.g., a pin adapter that is part of the illumination assembly 100 and/or part of the nock 2); attachment to the nock 2 by an insertion method (e.g., the illumination assembly 100 can insert into the nock 2, or the nock 2 can insert into the illumination assembly 100 and/or part of the arrow or bolt); attachment to the nock 2 by a connector initially separate from the nock 2 and/or initially separate from the illumination assembly 100).

In some embodiments, the illumination assembly 100 comprises the nock 2 as an integral part of the illumination assembly 100. Regardless of whether the nock 2 is provided by the illumination assembly 100, the nock 2 can be any nock suitable for interacting the a bow string to launch an arrow or bolt associated with the nock 2. For example, the nock 2 can provide nocking function using one or more of a traditional string capture method, a flat nock shape, a V-shaped nock or the like.

In a non-limiting embodiment, the illumination assembly 100 is part of or can be connected to one of the embodiments of the detachable tracking apparatus disclosed by U.S. Pat. No. 8,821,325 to Kirsch, entitled "Detachable Apparatus for Securing a Transmitting Device for use with a Hunting Arrow for Tracking Game," herein incorporated by reference in its entirety.

For example, as depicted in FIGS. 3-6, an embodiment of a detachable tracking apparatus 20 can include a front section 1 that can include a securing component 4 which is configured for securing the detachable tracking apparatus 20 to a target. The front section 1 may be made out of aluminum, carbon, acrylic polymer, plastic or another suitable durable material that has a high tensile strength to weight ratio. Preferably the detachable tracking apparatus 20 connects to an arrow by the front section 1 of the detachable tracking apparatus 20 connecting to a rear end of the shaft of the arrow such that the detachable tracking apparatus 20 will detach from the arrow shaft upon target collision.

The first wing 3*a* and the second wing 3*b* can form a stopping component 3 configured for detaching the detachable tracking apparatus 20 from the arrow after the arrow collides with the target. The detachable tracking apparatus 20 can further comprise the nock 2 which is configured to attach to the bow string. The detachable tracking apparatus 20 can further comprise a transmitting device that can comprise a power source 5 and a printed circuit board (PCB) 6. The rear section 7 of the detachable tracking apparatus 20 is preferably made out of a plastic polymer or other durable material that does not interfere with RF signal transmission.

EXAMPLES

The following non-limiting examples are for illustration only.

Figure 7:
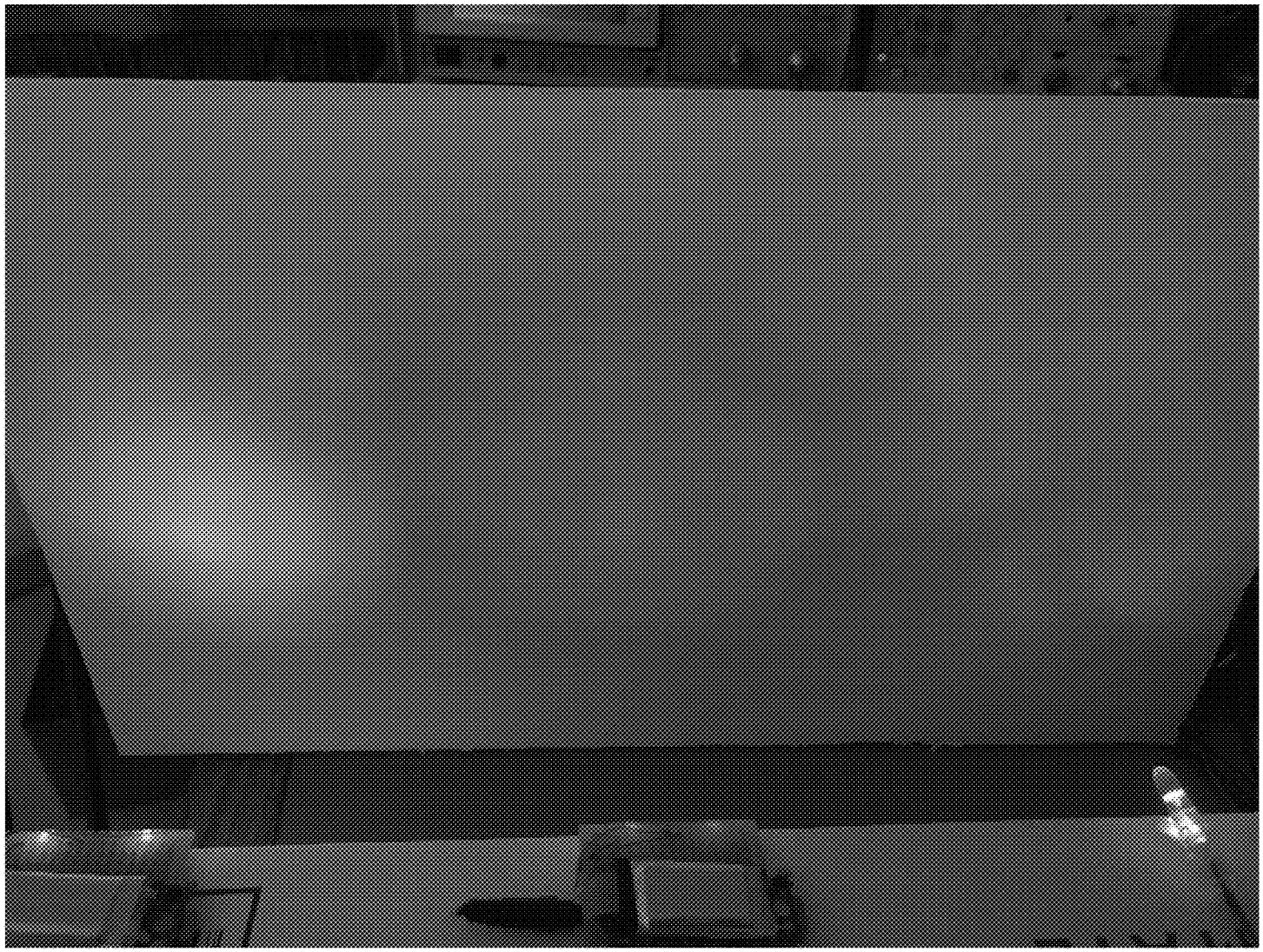
FIG. 7 is a side-by-side photographic comparison of light emission from embodiments of illumination assemblies according to the present disclosure (left side and middle) and light emission from a commercially available illumination assembly (right side).

FIG. 7 shows side-by-side comparison of an illumination assembly according to the present disclosure using 12 mA drive current (left side), an illumination assembly according to the present disclosure using 20 mA drive current (middle) and a commercially available illumination assembly (Firenock®, right side).

Figure 8A:
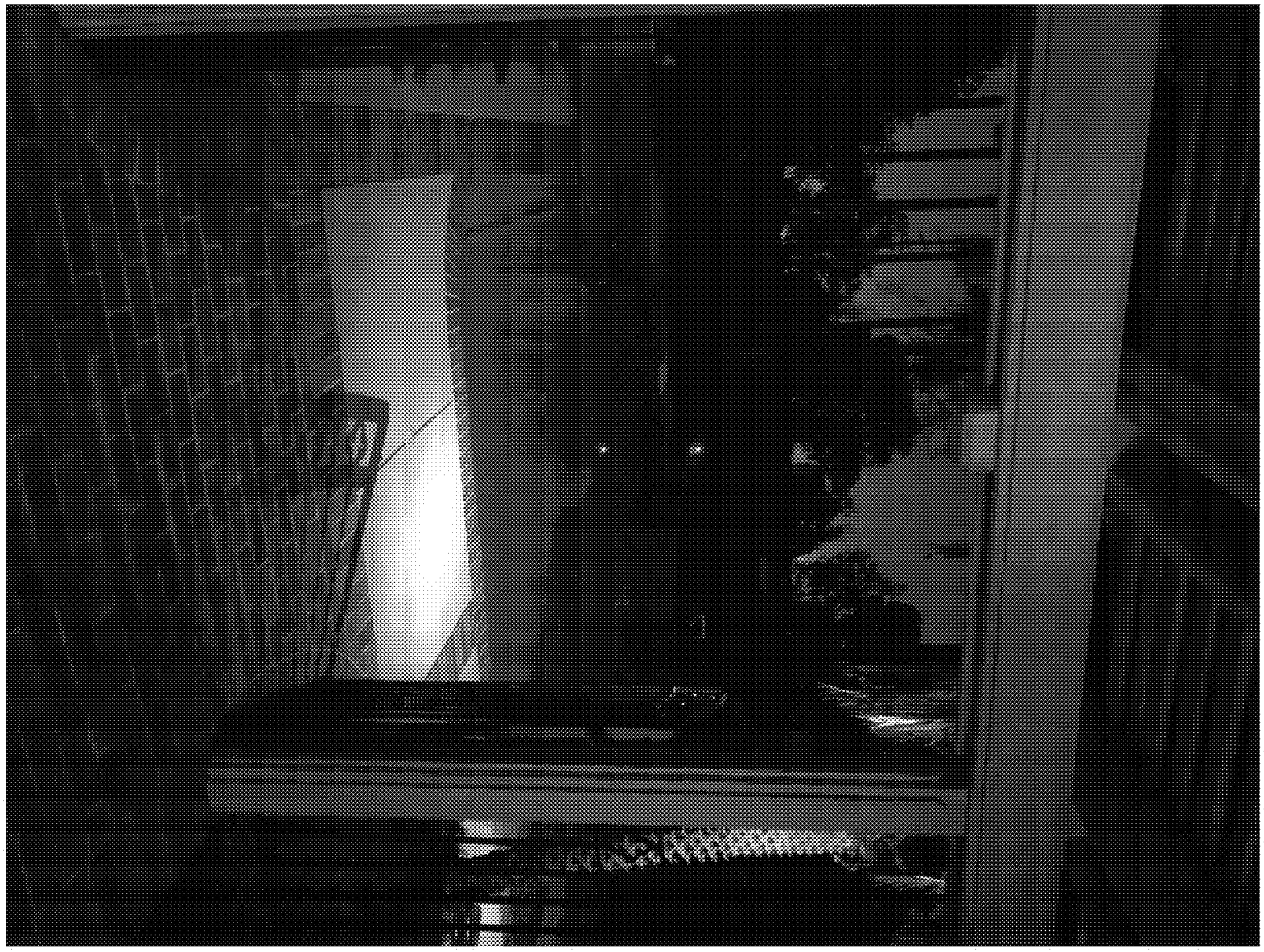
FIG. 8A is a photograph of experimental testing of a commercially available illumination assembly.
Figure 8B:
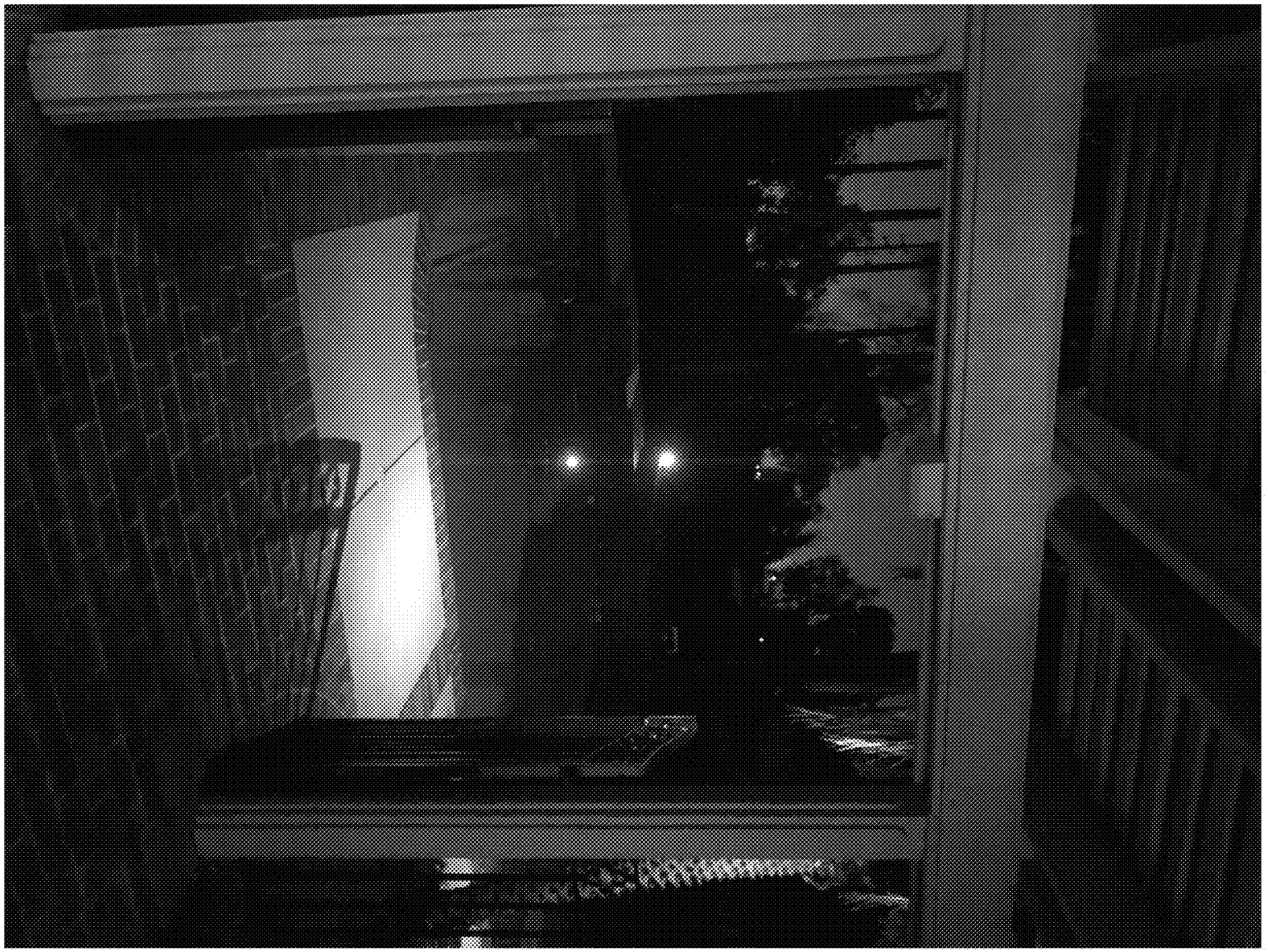
FIG. 8B is a photograph of experimental testing of an illumination assembly according to the present disclosure.

FIGS. 8A and 8B show experimental testing of the arrow-mounted light emitting element positioned off the center axis of the arrow, as disclosed herein. The device disclosed herein (FIG. 8B) provides not just a minor increase in the performance of the product, but orders of magnitude improvement over existing products (FIG. 8A).

Specifically, outdoor test photos were taken at a 25 yards range, which is a typical shooting distance in bow hunting. In the photograph, the difference in light radiation pattern and brightness can be seen by comparing an arrow with an arrow-mounted light emitting element positioned off the center axis of the arrow, as disclosed herein (on the left) to an arrow with a prior art nock in which the light emitting element is on the center axis (on the right). The prior art product was visible in the dark conditions at 25 yards, but the product according to the present disclosure exceeds the dynamic range of the camera and is blinding by comparison. In higher light conditions, the prior art product is not visible at 25 yards distance, whereas the product according to the present disclosure is visible at this distance, a critical difference.

Figure 9:
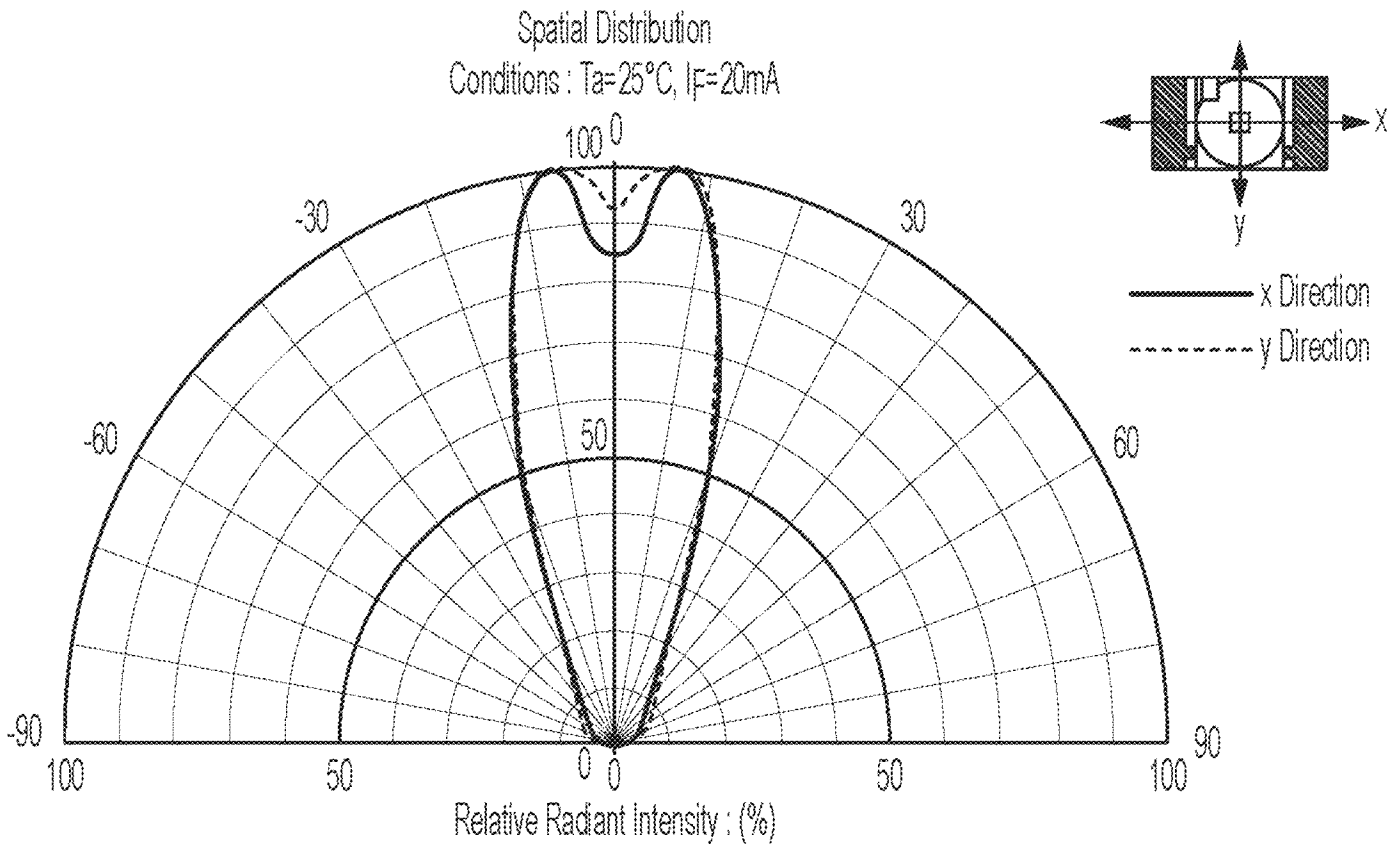
FIG. 9 is a graph showing the spatial distribution of the light achieved by an experimentally tested illumination assembly according to the present disclosure.

In a test in high overcast conditions, the product according to the present disclosure was visible at over 400 feet distance as shown in the LED test document. The reason can be seen in the spatial distribution plot of a light emitter according to the present disclosure (FIG. 9). This plot shows that the light power is concentrated in a +/−10 degree cone of radiation. It can be mathematically demonstrated that light emitters with equal power will have markedly different luminance depending on the focusing of the light.

The foregoing description has been presented for the purposes of illustration and description. It is not intended to be exhaustive or to limit the invention to the exemplary embodiments disclosed. Many modifications and variations are possible in light of the above teachings. It is intended that the scope of the invention be limited not by this detailed description of examples, but rather by the claims appended hereto.

The invention claimed is:

1. An illumination assembly comprising:

a first light emitting element;

at least one counterweight comprising a first counterweight;

at least one of a nock or a connector configured to attach the illumination assembly to a nock, wherein the first light emitting element and the at least one counterweight are positioned symmetrically from each other relative to the nock on opposite sides of the nock; and a power source configured to provide current to the first light emitting element.

2. The illumination assembly of claim 1, wherein the first light emitting element is substantially the same mass as the first counterweight.

3. The illumination assembly of claim 1, wherein the illumination assembly further comprises at least one of a shaft of an arrow or bolt or an adapter configured to attach to a shaft of an arrow or bolt, a central axis of the arrow or bolt extends through a tip of the arrow or bolt and the nock of the arrow or bolt, and the shaft of the arrow or bolt extends along the central axis, wherein the first light emitting element is positioned off of the central axis of the shaft of the arrow or bolt and configured to emit light in a rearward direction offset from the central axis of the shaft of the arrow or bolt, wherein the illumination assembly has a configuration selected from the group consisting of:

(i) the first light emitting element and the first counterweight are collinear on a virtual line substantially perpendicular to the central axis of the shaft of the arrow or bolt and (ii) the at least one counterweight further comprises a second counterweight, wherein the first light emitting element, the first counterweight are position at approximately one hundred twenty-degrees from each other relative to the central axis.

4. The illumination assembly of claim 3, wherein the first light emitting element is approximately the same distance from the central axis of the arrow or bolt as the first counterweight, along the virtual line perpendicular to the central axis.

5. The illumination assembly of claim 1, wherein the first counterweight comprises a second light emitting element.

6. The illumination assembly of claim 1, comprising a plurality of wings comprising at least a first wing and a second wing, wherein the first light emitting element is positioned in and/or on the first wing, and the first counterweight is positioned in and/or on the second wing.

7. The illumination assembly of claim 6, wherein the first counterweight comprises a second light emitting element.

8. The illumination assembly of claim 6, wherein the first light emitting element is positioned in and/or on a rearward facing surface of the first wing, and the first counterweight is positioned in and/or on a rearward facing surface of the first wing.

9. The illumination assembly of claim 1, wherein the power source is selected from the group consisting of a rechargeable battery, a primary battery, a charged capacitor, and a miniature fuel cell.

10. The illumination assembly of claim 1, comprising a first power charging post and a second power charging post which both are configured to convey current to the power source.

11. The illumination assembly of claim 10, wherein the first power charging post is substantially the same mass as the second power charging post.

12. The illumination assembly of claim 10, wherein the illumination assembly further comprises at least one of a shaft of an arrow or bolt or an adapter configured to attach to a shaft of an arrow or bolt, wherein the first power charging post, the second power charging post, the first light emitting element and the first counterweight are collinear on a virtual line substantially perpendicular to the central axis of the arrow or bolt.

13. The illumination assembly of claim 12, wherein the first power charging post is approximately the same distance from the central axis of the arrow or bolt as the second power charging post, along the virtual line perpendicular to the central axis.

14. The illumination assembly of claim 10, comprising a first wing and a second wing, wherein the first power charging post is positioned in and/or on the first wing, and the second power charging post is positioned in and/or on the second wing.

15. The illumination assembly of claim 1, comprising a plurality of wings comprising at least a first wing, a second wing and a third wing, wherein the first light emitting element is positioned in and/or on the first wing, the first counterweight is positioned in and/or on the second wing, and a second counterweight is positioned in and/or on the third wing, wherein the first, second and third wings are positioned approximately one hundred-twenty degrees from each other relative to the central axis.

16. The illumination assembly of claim 15, wherein the first counterweight comprises a second light emitting element.

17. The illumination assembly of claim 15, wherein the second counterweight comprises a third light emitting element.

18. The illumination assembly of claim 1, comprising a plurality of wings comprising at least a first wing, a second wing, a third wing and a fourth wing, wherein the first light emitting element is positioned in and/or on the first wing, the first counterweight is positioned in and/or on the second wing, a second counterweight is positioned in and/or on the third wing, and a third counterweight is positioned in and/or on the fourth wing, wherein the first, second, third and fourth wings are positioned approximately ninety degrees from each other relative to the central axis.

19. The illumination assembly of claim 18, wherein the first counterweight comprises a second light emitting element.

20. The illumination assembly of claim 19, wherein the second counterweight comprises a third light emitting element.

21. The illumination assembly of claim 20, wherein the third counterweight comprises a fourth light emitting element.

22. An arrow or bolt comprising the illumination assembly of claim 1.

23. An illumination assembly comprising:

a first light emitting element;

at least one counterweight comprising a first counterweight; and at least one of a nock or a connector configured to attach the illumination assembly to a nock, wherein the first light emitting element and the at least one counterweight are positioned symmetrically from each other relative to the nock on opposite sides of the nock, wherein the first counterweight does not have light emitting capability.

24. A method of tracking and/or providing light for an arrow or bolt comprising a shaft and a nock, wherein a central axis of the arrow or bolt extends through a tip of the arrow or bolt and the nock of the arrow or bolt, and the shaft of the arrow or bolt extends along the central axis, the arrow or bolt further comprising a first light emitting element positioned off the central axis of the arrow or bolt, the arrow or bolt further comprising a power source, the method comprising:

launching the arrow or bolt using interaction of the nock with a bowstring, the method further comprising transmitting light from the launched arrow or bolt, wherein the light is emitted from the first light emitting element positioned off the central axis of the arrow or bolt; and the power source providing current to the first light emitting element.

25. The method of claim 24, wherein substantially all of the light from the first light emitting element is not transmitted into or through the nock.

26. The method of claim 24, further comprising retrieving the arrow or bolt using the light emitted from the first light emitting element.

27. The method of claim 24, comprising at least one step selected from the group consisting of (i) connecting an illumination assembly to the shaft of the arrow or bolt, before the launching of the arrow or bolt, the illumination assembly comprising the first light emitting element; (ii) connecting an illumination assembly to the nock before the launching of the arrow or bolt, the illumination assembly comprising the first light emitting element; (iii) obtaining, before the launching of the arrow or bolt, the arrow or bolt with the first light emitting element already connected to the shaft of the arrow or bolt; (iv) obtaining, before the launching of the arrow or bolt, the arrow or bolt with the first light emitting element already connected to the nock.

* * * * *